US010085482B2

(12) United States Patent
Silvestrini

(10) Patent No.: US 10,085,482 B2
(45) Date of Patent: Oct. 2, 2018

(54) MULTIPLE USE AEROSOL-GENERATING SYSTEM

(71) Applicant: Philip Morris Products S.A., Neuchatel (CH)

(72) Inventor: Patrick Silvestrini, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/901,860

(22) PCT Filed: Jul. 2, 2014

(86) PCT No.: PCT/EP2014/064090

§ 371 (c)(1),
(2) Date: Dec. 29, 2015

(87) PCT Pub. No.: WO2015/000974

PCT Pub. Date: Jan. 8, 2015

(65) Prior Publication Data

US 2016/0286862 A1 Oct. 6, 2016

(30) Foreign Application Priority Data

Jul. 3, 2013 (EP) ..... 13174941

(51) Int. Cl.
*A61H 33/12* (2006.01)
*A24F 47/00* (2006.01)
*A24B 15/16* (2006.01)

(52) U.S. Cl.
CPC ..... *A24F 47/008* (2013.01); *A24B 15/16* (2013.01)

(58) Field of Classification Search
CPC .... A24F 47/008; A24F 47/002; A24F 47/006; A61M 11/042; A61M 15/0035;
(Continued)

(56) References Cited

U.S. PATENT DOCUMENTS 6,889,687 B1 * 5/2005 Olsson ..... A61M 15/0091 128/200.14
8,678,012 B2 * 3/2014 Li ..... A24F 47/008 128/202.21

(Continued)

FOREIGN PATENT DOCUMENTS

CN 101094599 A 12/2007
CN 201767029 U 3/2011

(Continued)

OTHER PUBLICATIONS

International Search Report dated Sep. 8, 2014 in PCT/EP2014/064090 filed Jul. 2, 2014.

(Continued)

*Primary Examiner* — Thor Campbell
(74) *Attorney, Agent, or Firm* — Oblon, McClelland, Maier & Neustadt, L.L.P.

(57) ABSTRACT

An aerosol-generating system is provided, including a housing having a first portion and a second portion. The housing includes an air inlet; a nicotine source; a volatile delivery enhancing compound source; and an air outlet. The first portion of the housing and the second portion of the housing are movable relative to one another between an open position and a closed position. In the open position, the air inlet and the air outlet are unobstructed and the nicotine source and the volatile delivery enhancing compound source are both in fluid communication with an airflow pathway through the housing between the air inlet and the air outlet. In the closed position, either the air inlet is obstructed or the nicotine source and the volatile delivery enhancing compound source are both not in fluid communication with an airflow pathway through the housing between the air inlet and the air outlet or both.

15 Claims, 4 Drawing Sheets

Figure 1A:
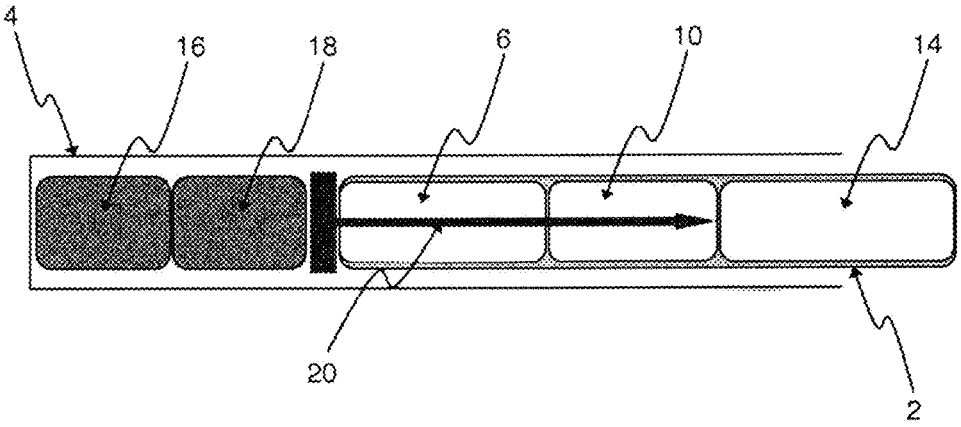

(58) Field of Classification Search
CPC ..... A61M 15/0001; A61M 15/06; A61M 15/0003; A61M 15/0066; A61M 15/0033; A61M 15/0021; B05B 7/2402; H05B 3/0014; H05B 1/0244
USPC ..... 392/404, 403, 386; 131/178, 194, 191; 219/494
See application file for complete search history.

(56) References Cited

U.S. PATENT DOCUMENTS

| | | | | |
|---|---|---|---|---|
| 8,997,753 | B2 * | 4/2015 | Li | H01C 17/00 128/202.21 |
| 9,095,175 | B2 * | 8/2015 | Terry | A24F 47/008 |
| 9,498,588 | B2 * | 11/2016 | Benassayag | A61M 15/06 |
| 2008/0241255 | A1 * | 10/2008 | Rose | A61K 31/4439 424/489 |
| 2008/0302374 | A1 * | 12/2008 | Wengert | A24F 47/004 131/178 |
| 2010/0059070 | A1 * | 3/2010 | Potter | A24F 47/004 131/194 |
| 2011/0226236 | A1 * | 9/2011 | Buchberger | A61M 11/041 128/200.23 |
| 2011/0290266 | A1 * | 12/2011 | Koller | A24F 47/006 131/328 |
| 2012/0006342 | A1 | 1/2012 | Rose et al. | |
| 2013/0056013 | A1 * | 3/2013 | Terry | A24F 47/008 131/328 |

FOREIGN PATENT DOCUMENTS

| | | | | |
|---|---|---|---|---|
| CN | 102014995 | A | 4/2011 | |
| CN | 202436108 | U | 9/2012 | |
| EP | 2 626 974 | A1 | 8/2013 | |
| JP | 2010-532672 | | 10/2010 | |
| KZ | 20193 | A | 11/2008 | |
| KZ | 26743 | B | 3/2013 | |
| TW | 201315395 | A1 | 4/2013 | |
| WO | WO 2008/121610 | A1 | 10/2008 | |
| WO | WO 2009/118085 | A1 | 10/2009 | |
| WO | WO 2009/132793 | A1 | 11/2009 | |
| WO | 2010 107613 | | 9/2010 | |
| WO | WO 2010107613 | A1 * | 9/2010 | A24F 47/008 |
| WO | WO 2011/034723 | A1 | 3/2011 | |
| WO | 2013 040193 | | 3/2013 | |
| WO | WO 2013/098410 | A2 | 7/2013 | |

OTHER PUBLICATIONS

Written Opinion of the International Searching Authority dated Sep. 8, 2014 in PCT/EP2014/064090 filed Jul. 2, 2014.

Extended European Search Report dated Dec. 9, 2013 in Patent Application No. 13174941.8.

Notice of Allowance dated Apr. 3, 2017 in Kazakhstan Patent Application No. 2016/0094.1 (with English translation).

Chinese Office Action and Search Report dated Feb. 1, 2018 in Chinese Patent Application No. 201480034033.6 with English Translation citing documents AO-AR cited therein, 20 pages.

Taiwanese Office Action and Search Report dated Dec. 7, 2017 in Taiwanese Patent Application No. 103122772 with English Translation citing document AO therein, 7 pages.

Japanese Office Action dated May 14, 2018 in Japanese Patent Application No. 2016-522604 with English Translation, 8 pages.

* cited by examiner

MULTIPLE USE AEROSOL-GENERATING SYSTEM

The present invention relates to a multiple use aerosol-generating system. In particular, the present invention relates to a multiple use aerosol-generating system for generating an aerosol comprising nicotine salt particles.

WO 2008/121610 A1, WO 2010/107613 A1 and WO 2011/034723 A1 disclose devices for delivering nicotine to a user comprising a nicotine source and a volatile delivery enhancing compound source. The nicotine and volatile delivery enhancing compound are reacted with one another in the gas phase to form an aerosol of nicotine salt particles that is inhaled by the user.

So-called 'e-cigarettes' that vaporise a liquid nicotine formulation to form an aerosol that is inhaled by a user are also known in the art. For example, WO 2009/132793 A1 discloses an electrically heated smoking system comprising a shell and a replaceable mouthpiece wherein the shell comprises an electric power supply and electric circuitry. The mouthpiece comprises a liquid storage portion, a capillary wick having a first end that extends into the liquid storage portion for contact with liquid therein, and a heating element for heating a second end of the capillary wick. In use, liquid is transferred from the liquid storage portion towards the heating element by capillary action in the wick. Liquid at the second end of the wick is vaporised by the heating element.

It would be desirable to provide a 'multiple use' e-cigarette or aerosol-generating system of the type disclosed in WO 2008/121610 A1, WO 2010/107613 A1 and WO 2011/034723 A1 that is capable of delivering multiple doses of an aerosol of nicotine salt particles to a user over a period of time.

Nicotine sources and volatile delivery enhancing compound sources for use in aerosol-generating systems of the type disclosed in WO 2008/121610 A1, WO 2010/107613 A1 and WO 2011/034723 A1 will have a tendency to lose nicotine and volatile delivery enhancing compound, respectively, when stored for any length of time. It would be desirable to provide a multiple use e-cigarette or aerosol-generating system of the type disclosed in WO 2008/121610 A1, WO 2010/107613 A1 and WO 2011/034723 A1 in which sufficient nicotine and volatile delivery enhancing compound is retained during storage to generate a desired aerosol of nicotine salt particles for delivery to a user upon each use of the aerosol-generating system.

It would also be desirable to provide a multiple use e-cigarette or aerosol-generating system of the type disclosed in WO 2008/121610 A1, WO 2010/107613 A1 and WO 2011/034723 A1 in which the nicotine and the volatile delivery enhancing compound is released only upon use of the aerosol-generating system.

It would further be desirable to provide a multiple use e-cigarette or aerosol-generating system of the type disclosed in WO 2008/121610 A1, WO 2010/107613 A1 and WO 2011/034723 A1 in which the nicotine and the volatile delivery enhancing compound are retained during storage without degradation by oxidation, hydrolysis or other unwanted reactions, which may alter the properties of the reactants.

According to the invention there is provided an aerosol-generating system comprising a housing having a first portion and a second portion, the housing comprising: an air inlet; a nicotine source; a volatile delivery enhancing compound source; and an air outlet. The first portion of the housing and the second portion of the housing are movable relative to one another between an open position in which the nicotine source and the volatile delivery enhancing compound source are both in fluid communication with an airflow pathway through the housing between the air inlet and the air outlet and a closed position in which the air flow pathway through the housing between the air inlet and the air outlet is obstructed or the nicotine source and the volatile delivery enhancing compound source are both not in fluid communication with the airflow pathway through the housing between the air inlet and the air outlet or both.

As used herein, the term "air inlet" is used to describe one or more apertures through which air may be drawn into the housing.

As used herein, the term "air outlet" is used to describe one or more apertures through which air may be drawn out of the housing.

As used herein, the term "obstructed" is used to indicate that the airflow pathway is blocked such that airflow into the housing through the air inlet, along the airflow pathway through the housing between the air inlet and the air outlet, and out of the housing through the air outlet is substantially prevented.

The first portion and the second portion of the housing of aerosol-generating systems according to the invention are movable relative to one another from the open position to the closed position. The first portion and the second portion of the housing of aerosol-generating systems according to the invention are also movable relative to one another from the closed position to the open position.

In the open position the airflow pathway through the housing between the air inlet and the air outlet is unobstructed. As used herein, the term "unobstructed" is used to indicate that an air stream may be drawn into the housing through the air inlet, along the airflow pathway through the housing between the air inlet and the air outlet, and out of the housing through the air outlet.

In the open position the nicotine source and the volatile delivery enhancing compound source are both in fluid communication with the airflow pathway through the housing between the air inlet and the air outlet. In use, in the open position this allows nicotine released from the nicotine source and volatile delivery enhancing compound released from the volatile delivery enhancing source to be entrained in an air stream drawn into the housing through the air inlet and along the airflow pathway through the housing between the air inlet and the air outlet. The nicotine and volatile delivery enhancing compound entrained in the air stream drawn along the airflow pathway through the housing between the air inlet and the air outlet react in the gas phase to form an aerosol of nicotine salt particles that is drawn out of the housing through the air outlet for delivery to a user.

In the closed position the air flow pathway through the housing between the air inlet and the air outlet is obstructed or the nicotine source and the volatile delivery enhancing compound source are both not in fluid communication with the airflow pathway through the housing between the air inlet and the air outlet or both. In use, in the closed position this prevents nicotine released from the nicotine source and volatile delivery enhancing compound released from the volatile delivery enhancing compound source from being entrained in an air stream drawn into the housing through the air inlet, along the airflow pathway through the housing between the air inlet and the air outlet, and out of the housing through the air outlet.

By moving the first portion and the second portion of the housing of the aerosol-generating systems relative to one another from the open position to the closed position between uses, sufficient nicotine and volatile delivery enhancing compound may advantageously be retained during storage of aerosol-generating systems according to the invention to generate a desired aerosol for delivery to a user upon each use of the aerosol-generating system.

In embodiments in which the airflow pathway through the housing between the air inlet and the air outlet is obstructed in the closed position, a user is prevented from drawing an air stream into the housing through the air inlet, along the airflow pathway through the housing between the air inlet and the air outlet, and out of the housing through the air outlet in the closed position.

The air inlet may be obstructed in the closed position. As used herein, the term "obstructed" is used to indicate that airflow into the housing through the air inlet is substantially prevented. In such embodiments the air flow pathway through the housing between the air inlet and the air outlet is obstructed in the closed position as airflow into the housing through the air inlet is substantially prevented in the closed position.

Alternatively or in addition, the air outlet may be obstructed in the closed position. As used herein, the term "obstructed" is used to indicate that airflow out of the housing through the air outlet is substantially prevented. In such embodiments the airflow pathway through the housing between the air inlet and the air outlet is obstructed in the closed position as airflow out of the housing through the air outlet is substantially prevented in the closed position.

Alternatively or in addition, the airflow pathway through the housing may be obstructed between the air inlet and the air outlet in the closed position. As used herein, the term "obstructed" is used to indicate that airflow that between the air inlet and the air outlet is substantially prevented. In such embodiments the airflow pathway through the housing between the air inlet and the air outlet is obstructed in the closed position as airflow along the airflow pathway through the housing between the air inlet and the air outlet is substantially prevented in the closed position.

In embodiments in which the nicotine source and the volatile delivery enhancing compound source are both not in fluid communication with the airflow pathway through the housing between the air inlet and the air outlet in the closed position, nicotine released from the nicotine source and volatile delivery enhancing compound released from the volatile delivery enhancing compound source is prevented from being entrained in an air stream drawn into the housing through the air inlet, along the airflow pathway through the housing between the air inlet and the air outlet, and out of the housing through the air outlet in the closed position.

In certain preferred embodiments, the nicotine source communication and the volatile delivery enhancing compound source are not in fluid communication with one another in the closed position. This advantageously prevents nicotine released from the nicotine source reacting with volatile delivery enhancing compound released from the volatile delivery enhancing source in the closed position.

The nicotine source and the volatile delivery enhancing compound source may both be located in the first portion of the housing. In such embodiments, the second portion of the housing may be separated from the first portion of the housing in the open position.

In certain embodiments the aerosol-generating system may comprise a housing having a first portion and a second portion, the first portion of the housing comprising: an air inlet; a nicotine source; a volatile delivery enhancing compound source; and an air outlet, wherein the first portion of the housing and the second portion of the housing are movable relative to one another between an open position in which the nicotine source and the volatile delivery enhancing compound source are both in fluid communication with an airflow pathway through the first portion of the housing between the air inlet and the air outlet and a closed position in which one or both of the air inlet and the air outlet are obstructed by the second portion of the housing.

In such embodiments, the second portion of the housing may be a removable cap, cover or sleeve that at least partially overlies the first portion of the housing in the closed position thereby obstructing one or both of the air inlet and the air outlet and that in the open position is removed from the first portion of the housing thereby exposing the air inlet and the air outlet.

Alternatively, a first one of the nicotine source and the volatile delivery enhancing compound source may be located in the first portion of the housing and a second one of the nicotine source and the volatile delivery enhancing compound source may be located in the second portion of the housing.

As used herein, the terms "proximal" and "distal" are used to describe the relative positions of components, or portions of components, of aerosol-generating systems according to the invention.

The aerosol-generating system comprises a proximal end through which, in use, an aerosol exits the aerosol-generating system for delivery to a user. The proximal end of the aerosol-generating system may also be referred to as the mouth end. In use, in the open position a user draws on the proximal end of the aerosol-generating system in order to inhale an aerosol generated by the aerosol-generating system. The aerosol-generating article system comprises a distal end opposed to the proximal end.

As used herein, the term "longitudinal" is used to describe the direction between the proximal end and the opposed distal end of the aerosol-generating system and the term "transverse" is used to describe the direction perpendicular to the longitudinal direction.

The air outlet is located at the proximal end of the housing of the aerosol-generating system. The air inlet may be located at the distal end of the housing of the aerosol-generating system. Alternatively, the air inlet may be located between the proximal end and the distal end of the housing of the aerosol-generating system.

As used herein, the terms "upstream" and "downstream" are used to describe the relative positions of components, or portions of components, of aerosol-generating systems according to the invention with respect to the direction of airflow along the airflow pathway between the air inlet and the air outlet when a user draws on the proximal end of the aerosol-generating system in the open position.

In the open position when a user draws on the proximal end of the aerosol-generating system air is drawn into the housing through the air inlet, passes downstream along the airflow pathway through the housing between the air inlet and the air outlet, and exits the housing through the air outlet at the proximal end of the aerosol-generating system.

The proximal end of the aerosol-generating system may also be referred to as the downstream end and components, or portions of components, of the aerosol-generating system may be described as being upstream or downstream of one another based on their positions relative to the airflow through the housing of the aerosol-generating system between the air inlet and the air outlet.

The first portion of the housing and the second portion of the housing are configured so that a user may manually move the first portion of the housing and the second portion of the housing relative to one another between the open position and the closed position.

The first portion of the housing and the second portion of the housing may be configured so that a user may, for example, push, pull, twist or rotate one or both of the first portion of the housing and the second portion of the housing in order to move the first portion of the housing and the second portion of the housing relative to one another between the open position and the closed position.

The first portion of the housing and the second portion of the housing may be movable along a longitudinal axis of the housing relative to one another between the open position and the closed position. In such embodiments, the length of the housing in the open position may be greater than the length of the housing in the closed position. Alternatively, the length of the housing in the open position may be shorter than the length of the housing in the closed position.

Alternatively, the first portion of the housing and the second portion of the housing may be movable along a transverse axis of the housing relative to one another between the open position and the closed position.

The first portion of the housing and the second portion of the housing may be slidable relative to one another between the open position and the closed position.

In certain embodiments, the first portion of the housing and the second portion of the housing may be slidable relative to one another along a longitudinal axis of the aerosol-generating system between the open position and the closed position.

In other embodiments, the first portion of the housing and the second portion of the housing may be slidable relative to one another along a transverse axis of the aerosol-generating system between the open position and the closed position.

Alternatively, the first portion of the housing and the second portion of the housing may be rotatable relative to one another between the open position and the closed position.

In certain embodiments, the first portion of the housing and the second portion of the housing may be rotatable relative to one another about a longitudinal axis of the aerosol-generating system between the open position and the closed position.

In other embodiments, the first portion of the housing and the second portion of the housing may be rotatable relative to one another about a transverse axis of the aerosol-generating system between the open position and the closed position.

In certain embodiments, the aerosol-generating system may comprise one or more first apertures in the first portion of the housing and one or more second apertures in the second portion of the housing may comprise, wherein in the open position the one or more first apertures in the first portion of the housing and the one or more second apertures in the second portion of the housing are substantially aligned and wherein in the closed position the one or more first apertures in the first portion of the housing and the one or more second apertures in the second portion of the housing are substantially misaligned.

In use, movement of the first portion of the housing and the second portion of the housing relative to one another between the open position and the closed position allows the degree of registry between the one or more first apertures and the one or more second apertures to be varied.

In such embodiments substantial alignment of the one or more first apertures in the first portion of the housing and the one or more second apertures in the second portion of the housing in the open position may provide fluid communication between the nicotine source and the volatile delivery enhancing compound and the airflow pathway through the housing from the air inlet to the air outlet in the open position In such embodiments substantial misalignment of one or more first apertures in the first portion of the housing and the one or more second apertures in the second portion of the housing in the closed position may obstruct the airflow pathway through the housing between the air inlet and the air outlet in the closed position.

Alternatively or in addition, in such embodiments substantial misalignment of one or more first apertures in the first portion of the housing and the one or more second apertures in the second portion of the housing in the closed position may prevent one or both of fluid communication between the nicotine source and the airflow pathway through the housing between the air inlet and the air outlet and fluid communication between the volatile delivery enhancing compound source and the airflow pathway through the housing between the air inlet and the air outlet in the closed position.

The first portion of the housing and the second portion of the housing may comprise the same or different numbers of first apertures and second apertures, respectively.

The first portion of the housing and the second portion of the housing may abut one another in one or both of the open position and the closed position. For example, where the first portion of the housing and the second portion of the housing are rotatable relative to one another about the longitudinal axis of housing the open position and the closed position, the first portion of the housing and the second portion of the housing may abut one another in the open position and the closed position.

Alternatively, first portion of the housing and the second portion of the housing may be longitudinally spaced apart from one another in one or both of the open position and the closed position. For example, where the first portion of the housing and the second portion of the housing are movable along the longitudinal axis of the housing relative to one another between the open position and the closed position, the first portion of the housing and the second portion of the housing may be longitudinally spaced apart from one another in the open position and abut one another in the closed position.

Alternatively, the second portion of the housing may overlie or underlie at least part of the first portion of the housing in one or both of the open position and the closed position.

The housing may comprise a first compartment comprising the nicotine source and a second compartment comprising the volatile delivery enhancing compound source.

The first compartment may be sealed by one or more removable or frangible barriers prior to first use of the aerosol-generating system. In certain embodiments, the first compartment may be sealed by a pair of opposed transverse removable or frangible barriers.

Alternatively or in addition, the second compartment may be sealed by one or more removable or frangible barriers prior to first use of the aerosol-generating system. In certain embodiments, the second compartment may be sealed by a pair of opposed transverse removable or frangible barriers.

The one or more removable or frangible barriers may be formed from any suitable material. For example, the one or more removable or frangible barriers may be formed from a metal foil or film.

In such embodiments, the aerosol-generating system may further comprise a piercing member for piercing one or more frangible barriers sealing one or both of the first compartment and the second compartment prior to first use of the aerosol-generating system.

The first compartment and the second compartment may abut one another. Alternatively, the first compartment and the second compartment may be spaced apart from one another.

The volume of the first compartment and the second compartment may be the same or different. The first compartment should contain sufficient nicotine and the second compartment should comprise sufficient volatile delivery enhancing compound to generate multiple doses of aerosol for delivery to a user.

As described further below, the nicotine source and the volatile delivery enhancing compound source may be arranged in series or parallel within the housing of the aerosol-generating system.

As used herein, by "series" it is meant that the nicotine source and the volatile delivery enhancing compound source are arranged within the housing of the aerosol-generating system so that in the open position an air stream drawn along the airflow pathway through the housing between the air inlet and the air outlet passes a first one of the nicotine source and the volatile delivery enhancing compound source and then passes a second one of the nicotine source and the volatile delivery enhancing compound source.

In such embodiments nicotine vapour is released from the nicotine source into the air stream drawn along the airflow pathway through the housing between the air inlet and the air outlet and volatile delivery enhancing compound vapour is released from the volatile delivery enhancing compound source into the air stream drawn along the airflow pathway through the housing between the air inlet and the air outlet. As described above the nicotine vapour reacts with the volatile delivery enhancing compound vapour in the gas phase to form an aerosol, which is delivered to a user through the air outlet.

Where the nicotine source and the volatile delivery enhancing compound source are arranged in series within the aerosol-generating system, the volatile delivery enhancing compound source is preferably downstream of the nicotine source so that in the open position an air stream drawn along the airflow pathway through the housing between the air inlet and the air outlet passes the nicotine source and then passes the volatile delivery enhancing compound source. However, it will be appreciated that the volatile delivery enhancing compound source may alternatively be upstream of the nicotine source so that in the open position an air stream drawn along the airflow pathway through the housing between the air inlet and the air outlet passes the volatile delivery enhancing compound source and then passes the nicotine source.

In certain preferred embodiments, the nicotine source and the volatile delivery enhancing compound source are arranged in series from air inlet to air outlet within the housing with the nicotine source downstream of the air inlet, the volatile delivery enhancing compound source downstream of the nicotine source and the air outlet downstream of the volatile delivery enhancing compound source.

As used herein, by "parallel" it is meant that the nicotine source and the volatile delivery enhancing compound source are arranged within the housing of the aerosol-generating system so that in the open position a first air stream drawn along the airflow pathway through the housing between the air inlet and the air outlet passes the nicotine source and a second air stream drawn along the airflow pathway through the housing between the air inlet and the air outlet passes the volatile delivery enhancing compound source.

In such embodiments nicotine vapour is released from the nicotine source into the first air stream drawn along the airflow pathway through the housing between the air inlet and the air outlet and volatile delivery enhancing compound vapour is released from the volatile delivery enhancing compound source into the second air stream drawn along the airflow pathway through the housing between the air inlet and the air outlet. The nicotine vapour in the first air stream reacts with the volatile delivery enhancing compound vapour in the second air stream in the gas phase to form an aerosol, which is delivered to a user through the air outlet.

In certain preferred embodiments, the nicotine source and the volatile delivery enhancing compound source are arranged in parallel within the housing with the nicotine source and the volatile delivery enhancing compound source both downstream of the air inlet and upstream of the air outlet. In such embodiments in the open position a first portion of an air stream drawn into the housing through the air inlet and along the airflow pathway through the housing between the air inlet and the air outlet passes the nicotine source and a second portion of the air stream drawn into the housing through the air inlet and along the airflow pathway through the housing between the air inlet and the air outlet passes the volatile delivery enhancing compound source. The nicotine vapour in the first portion of the air stream reacts with the volatile delivery enhancing compound vapour in the second portion of the air stream in the gas phase to form an aerosol, which is delivered to a user through the air outlet.

In other preferred embodiments, the air inlet comprises a first air inlet and a second air inlet and the nicotine source and the volatile delivery enhancing compound source are arranged in parallel within the housing with the nicotine source downstream of the first air inlet and upstream of the air outlet and the volatile delivery enhancing compound source downstream of the second air inlet and upstream of the air outlet. In such embodiments in the open position a first air stream drawn into the housing through the first air inlet and along the airflow pathway through the housing between the air inlet and the air outlet passes the nicotine source and a second air stream drawn into the housing through the second air inlet and along the airflow pathway through the housing between the air inlet and the air outlet passes the volatile delivery enhancing compound source. The nicotine vapour in the first air stream reacts with the volatile delivery enhancing compound vapour in the second air stream in the gas phase to form an aerosol, which is delivered to a user through the air outlet.

It will be appreciated that where the housing of the aerosol-generating system comprises a first compartment comprising the nicotine source and a second compartment comprising the volatile delivery enhancing compound source, the first compartment and the second compartment may be arranged in series or parallel within the housing as described above.

In embodiments in which the first compartment and the second compartment are arranged in series within the housing and the second compartment is downstream of the first compartment, in use in the open position nicotine vapour may react with volatile delivery enhancing compound vapour to form an aerosol in the second compartment. In such embodiments the housing may further comprise a third compartment downstream of the second compartment and the nicotine vapour may alternatively or in addition react with the volatile delivery enhancing compound vapour to form an aerosol in the third compartment.

In embodiments in which the first compartment and the second compartment are arranged in series within the housing and the second compartment is upstream of the first compartment, in use in the open position volatile delivery enhancing compound vapour may react with nicotine vapour in the first compartment. In such embodiments the housing may further comprise a third compartment downstream of the first compartment and the volatile delivery enhancing compound vapour may alternatively or in addition react with the nicotine vapour to form an aerosol in the third compartment.

In embodiments in which the first compartment and the second compartment are arranged in parallel within the housing, the housing may further comprise a third compartment downstream of the first compartment and the second compartment and the nicotine vapour in the first air stream and the volatile delivery enhancing compound vapour in the second air stream may mix and react in the third compartment to form an aerosol.

Where present, the third compartment may comprise one or more aerosol-modifying agents. For example, the third compartment may comprise an adsorbent, such as activated carbon, a flavourant, such as menthol, or a combination thereof.

The housing may further comprise a mouthpiece downstream of the nicotine source and volatile delivery enhancing compound source.

Where the housing of the aerosol-generating system comprises a first compartment comprising the nicotine source, a second compartment comprising the volatile delivery enhancing compound source and optionally a third compartment, the housing may further comprise a mouthpiece downstream of the first compartment, the second compartment and, where present, the third compartment. Where present, the mouthpiece may comprise a filter. The filter may have a low particulate filtration efficiency or very low particulate filtration efficiency. Alternatively, the mouthpiece may comprise a hollow tube.

Aerosol-generating systems according to the invention comprise a volatile delivery enhancing compound source. As used herein, by "volatile" it is meant the delivery enhancing compound has a vapour pressure of at least about 20 Pa. Unless otherwise stated, all vapour pressures referred to herein are vapour pressures at 25° C. measured in accordance with ASTM E1194-07.

Preferably, the volatile delivery enhancing compound has a vapour pressure of at least about 50 Pa, more preferably at least about 75 Pa, most preferably at least 100 Pa at 25° C.

Preferably, the volatile delivery enhancing compound has a vapour pressure of less than or equal to about 400 Pa, more preferably less than or equal to about 300 Pa, even more preferably less than or equal to about 275 Pa, most preferably less than or equal to about 250 Pa at 25° C.

In certain embodiments, the volatile delivery enhancing compound may have a vapour pressure of between about 20 Pa and about 400 Pa, more preferably between about 20 Pa and about 300 Pa, even more preferably between about 20 Pa and about 275 Pa, most preferably between about 20 Pa and about 250 Pa at 25° C.

In other embodiments, the volatile delivery enhancing compound may have a vapour pressure of between about 50 Pa and about 400 Pa, more preferably between about 50 Pa and about 300 Pa, even more preferably between about 50 Pa and about 275 Pa, most preferably between about 50 Pa and about 250 Pa at 25° C.

In further embodiments, the volatile delivery enhancing compound may have a vapour pressure of between about 75 Pa and about 400 Pa, more preferably between about 75 Pa and about 300 Pa, even more preferably between about 75 Pa and about 275 Pa, most preferably between about 75 Pa and about 250 Pa at 25° C.

In yet further embodiments, the volatile delivery enhancing compound may have a vapour pressure of between about 100 Pa and about 400 Pa, more preferably between about 100 Pa and about 300 Pa, even more preferably between about 100 Pa and about 275 Pa, most preferably between about 100 Pa and about 250 Pa at 25° C.

The volatile delivery enhancing compound may comprise a single compound. Alternatively, the volatile delivery enhancing compound may comprise two or more different compounds.

Where the volatile delivery enhancing compound comprises two or more different compounds, the two or more different compounds in combination have a vapour pressure of at least about 20 Pa at 25° C.

Preferably, the volatile delivery enhancing compound is a volatile liquid.

The volatile delivery enhancing compound may comprise a mixture of two or more different liquid compounds.

The volatile delivery enhancing compound may comprise an aqueous solution of one or more compounds. Alternatively the volatile delivery enhancing compound may comprise a non-aqueous solution of one or more compounds.

The volatile delivery enhancing compound may comprise two or more different volatile compounds. For example, the volatile delivery enhancing compound may comprise a mixture of two or more different volatile liquid compounds.

Alternatively, the volatile delivery enhancing compound may comprise one or more non-volatile compounds and one or more volatile compounds. For example, the volatile delivery enhancing compound may comprise a solution of one or more non-volatile compounds in a volatile solvent or a mixture of one or more non-volatile liquid compounds and one or more volatile liquid compounds.

In certain embodiments, the volatile delivery enhancing compound comprises an acid. The volatile delivery enhancing compound may comprise an organic acid or an inorganic acid. Preferably, the volatile delivery enhancing compound comprises an organic acid, more preferably a carboxylic acid, most preferably lactic acid or an alpha-keto or 2-oxo acid.

In preferred embodiments, the volatile delivery enhancing compound comprises an acid selected from the group consisting of lactic acid, 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid and combinations thereof. In particularly preferred embodiments, the volatile delivery enhancing compound comprises lactic acid or pyruvic acid.

In preferred embodiments, the volatile delivery enhancing compound source comprises a sorption element and a volatile delivery enhancing compound sorbed on the sorption element.

As used herein, by "sorbed" it is meant that the volatile delivery enhancing compound is adsorbed on the surface of the sorption element, or absorbed in the sorption element, or both adsorbed on and absorbed in the sorption element. Preferably, the volatile delivery enhancing compound is adsorbed on the sorption element.

The sorption element may be formed from any suitable material or combination of materials. For example, the sorption element may comprise one or more of glass, stainless steel, aluminium, polyethylene (PE), polypropylene, polyethylene terephthalate (PET), polybutylene terephthalate (PBT), polytetrafluoroethylene (PTFE), expanded polytetrafluoroethylene (ePTFE), and BAREX®.

In preferred embodiments, the sorption element is a porous sorption element.

For example, the sorption element may be a porous sorption element comprising one or more materials selected from the group consisting of porous plastic materials, porous polymer fibres and porous glass fibres.

The sorption element is preferably chemically inert with respect to the volatile delivery enhancing compound.

The sorption element may have any suitable size and shape.

In certain preferred embodiments, the sorption element is a substantially cylindrical plug. In certain particularly preferred embodiments, the sorption element is a porous substantially cylindrical plug.

In other preferred embodiments, the sorption element is a substantially cylindrical hollow tube. In other particularly preferred embodiments, the sorption element is a porous substantially cylindrical hollow tube.

The size, shape and composition of the sorption element may be chosen to allow a desired amount of volatile delivery enhancing compound to be sorbed on the sorption element.

The volatile delivery enhancing compound source should comprise sufficient volatile delivery enhancing compound to generate multiple doses of aerosol for delivery to a user.

In preferred embodiments, between about 20 μl and about 200 μl, more preferably between about 40 μl and about 150 μl, most preferably between about 50 μl and about 100 μl of the volatile delivery enhancing compound is sorbed on the sorption element.

The sorption element advantageously acts as a reservoir for the volatile delivery enhancing compound.

Aerosol-generating systems according to the invention also comprise a nicotine source. The nicotine source may comprise one or more of nicotine, nicotine base, a nicotine salt, such as nicotine-HCl, nicotine-bitartrate, or nicotine-ditartrate, or a nicotine derivative.

The nicotine source may comprise natural nicotine or synthetic nicotine.

The nicotine source may comprise pure nicotine, a solution of nicotine in an aqueous or non-aqueous solvent or a liquid tobacco extract.

The nicotine source may further comprise an electrolyte forming compound. The electrolyte forming compound may be selected from the group consisting of alkali metal hydroxides, alkali metal oxides, alkali metal salts, alkaline earth metal oxides, alkaline earth metal hydroxides and combinations thereof.

For example, the nicotine source may comprise an electrolyte forming compound selected from the group consisting of potassium hydroxide, sodium hydroxide, lithium oxide, barium oxide, potassium chloride, sodium chloride, sodium carbonate, sodium citrate, ammonium sulfate and combinations thereof.

In certain embodiments, the nicotine source may comprise an aqueous solution of nicotine, nicotine base, a nicotine salt or a nicotine derivative and an electrolyte forming compound.

Alternatively or in addition, the nicotine source may further comprise other components including, but not limited to, natural flavours, artificial flavours and antioxidants.

The nicotine source may comprise a sorption element and nicotine sorbed on the sorption element.

As used herein, by "sorbed" it is meant that the nicotine is adsorbed on the surface of the sorption element, or absorbed in the sorption element, or both adsorbed on and absorbed in the sorption element.

The sorption element may be formed from any suitable material or combination of materials. For example, the sorption element may comprise one or more of glass, stainless steel, aluminium, polyethylene (PE), polypropylene, polyethylene terephthalate (PET), polybutylene terephthalate (PBT), polytetrafluoroethylene (PTFE), expanded polytetrafluoroethylene (ePTFE), and BAREX®.

In preferred embodiments, the sorption element is a porous sorption element.

For example, the sorption element may be a porous sorption element comprising one or more materials selected from the group consisting of porous plastic materials, porous polymer fibres and porous glass fibres.

The sorption element is preferably chemically inert with respect to the nicotine.

The sorption element may have any suitable size and shape.

In certain preferred embodiments, the sorption element is a substantially cylindrical plug. In certain particularly preferred embodiments, the sorption element is a porous substantially cylindrical plug.

In other preferred embodiments, the sorption element is a substantially cylindrical hollow tube. In other particularly preferred embodiments, the sorption element is a porous substantially cylindrical hollow tube.

The size, shape and composition of the sorption element may be chosen to allow a desired amount of nicotine to be sorbed on the sorption element.

The nicotine source should comprise sufficient nicotine to generate multiple doses of aerosol for delivery to a user.

In preferred embodiments, between about 50 μl and about 150 μl, more preferably about 100 μl of nicotine is sorbed on the sorption element.

The sorption element advantageously acts as a reservoir for the nicotine.

It will be appreciated that the nicotine source and the delivery enhancing compound source may comprise sorption elements having the same or different composition.

It will be appreciated that the nicotine source and the delivery enhancing compound source may comprise sorption elements of the same or different size and shape.

The aerosol-generating system may comprise: an aerosol-generating article comprising the nicotine source and the delivery enhancing compound source; and an aerosol-generating device comprising: a cavity configured to receive the nicotine source and the delivery enhancing compound source of the aerosol-generating article; and heating means for heating one or both of the nicotine source and the delivery enhancing compound source of the aerosol-generating article within the cavity.

As used herein, the term "aerosol-generating article" refers to an article comprising an aerosol-forming substrate capable of releasing volatile compounds, which can form an aerosol.

As used herein, the term "aerosol-generating device" refers to a device that interacts with an aerosol-generating article to generate an aerosol that is directly inhalable into a user's lungs thorough the user's mouth.

It will also be appreciated that where the aerosol-generating system comprises an aerosol-generating article comprising the nicotine source and the volatile delivery enhancing compound source, the nicotine source and the volatile delivery enhancing compound source may be arranged in series or parallel within the aerosol-generating article as described above.

The aerosol-generating article may comprise a first compartment comprising the nicotine source and a second compartment comprising the volatile delivery enhancing compound source.

It will be appreciated that where the aerosol-generating system comprises an aerosol-generating article comprising a first compartment comprising the nicotine source and a second compartment comprising the volatile delivery enhancing compound source, the first compartment and the second compartment may be arranged in series or parallel within the aerosol-generating article as described above.

The first compartment and the second compartment may abut one another. Alternatively, the first compartment and the second compartment may be spaced apart from one another. In certain embodiments, the first compartment and the second compartment may be spaced apart from one another in order to reduce heat transfer between the first compartment and the second compartment.

The first compartment may be sealed by one or more removable or frangible barriers prior to first use of the aerosol-generating system. In certain embodiments, the first compartment may be sealed by a pair of opposed transverse removable or frangible barriers.

Alternatively or in addition, the second compartment may be sealed by one or more removable or frangible barriers prior to first use of the aerosol-generating system. In certain embodiments, the second compartment may be sealed by a pair of opposed transverse removable or frangible barriers.

The one or more removable or frangible barriers may be formed from any suitable material. For example, the one or more removable or frangible barriers may be formed from a metal foil or film.

In such embodiments, the aerosol-generating device may further comprise a piercing member positioned within the cavity for piercing one or more frangible barriers sealing one or both of the first compartment and the second compartment of the aerosol-generating article prior to first use of the aerosol-generating system.

The piercing member may be formed from any suitable material.

Where the first compartment and the second compartment are arranged in series within the aerosol-generating article, the piercing member is preferably positioned centrally within the cavity of the aerosol-generating device, along the major axis of the cavity.

Where the first compartment and the second compartment article are arranged in parallel within the aerosol-generating article, the piercing member may comprise a first piercing element positioned within the cavity of the aerosol-generating device for piercing the first compartment of the aerosol-generating article and a second piercing element positioned within the cavity of the aerosol-generating device for piercing the second compartment of the aerosol-generating article.

The volume of the first compartment and the second compartment may be the same or different. The first compartment should contain sufficient nicotine and the second compartment should comprise sufficient volatile delivery enhancing compound to generate multiple doses of aerosol for delivery to a user.

The aerosol-generating article may further comprise a mouthpiece downstream of the nicotine source and volatile delivery enhancing compound source.

The aerosol-generating article is preferably substantially cylindrical in shape.

The aerosol-generating article may have a transverse cross-section of any suitable shape.

Preferably, the aerosol-generating article is of substantially circular transverse cross-section or of substantially elliptical transverse cross-section. More preferably, the aerosol-generating article is of substantially circular transverse cross-section.

The aerosol-generating article may simulate the shape and dimensions of a tobacco smoking article, such as a cigarette, a cigar, a cigarillo or a pipe, or a cigarette pack. In preferred embodiments, the aerosol-generating article simulates the shape and dimensions of a cigarette.

The aerosol-generating device comprises a cavity configured to receive the first compartment and the second compartment of the aerosol-generating article.

Preferably, the cavity of the aerosol-generating device is substantially cylindrical.

The cavity of the aerosol-generating device may have a transverse cross-section of any suitable shape. For example, the cavity may be of substantially circular, elliptical, triangular, square, rhomboidal, trapezoidal, pentagonal, hexagonal or octagonal transverse cross-section.

As used herein, the term "transverse cross-section" is used to describe the cross-section of the cavity perpendicular to the major axis of the cavity.

Preferably, the cavity of the aerosol-generating device has a transverse cross-section of substantially the same shape as the transverse cross-section of the aerosol-generating article.

In certain embodiments, the cavity of the aerosol-generating device may have a transverse cross-section of substantially the same shape and dimensions as the transverse cross-section of the aerosol-generating article to be received in the cavity in order to maximize conductive thermal transfer from the aerosol-generating device to the aerosol-generating article.

Preferably, the cavity of the aerosol-generating device is of substantially circular transverse cross-section or of substantially elliptical transverse cross-section. Most preferably, the cavity of the aerosol-generating device is of substantially circular transverse cross-section.

Preferably, the length of the cavity of the aerosol-generating device is less than the length of the aerosol-generating article so that when the aerosol-generating article is received in the cavity of the aerosol-generating device the proximal end of the aerosol-generating article projects from the cavity of the aerosol-generating device.

As used herein, by "length" is meant the maximum longitudinal dimension between the distal end and the proximal end of the cavity and aerosol-generating article.

Preferably, the cavity of the aerosol-generating device has a diameter substantially equal to or slightly greater than the diameter of the aerosol-generating article.

As used herein, by "diameter" is meant the maximum transverse dimension of the cavity and aerosol-generating article.

The aerosol-generating device comprises heating means for heating one or both of the nicotine source and the delivery enhancing compound source of the aerosol-generating article within the cavity.

The heating means of the aerosol-generating device may comprise an external heater positioned about a perimeter of the cavity.

As used herein, the term "external heater" refers to a heater that in use is positioned externally to an aerosol-generating article received in the cavity of the aerosol-generating device.

Alternatively or in addition, the heating means of the aerosol-generating device may comprise an internal heater positioned within the cavity.

As used herein, the term "internal heater" refers to a heater that in use is positioned internally to an aerosol-generating article received in the cavity of the aerosol-generating device.

The aerosol-generating device may be configured to heat one or both of the nicotine source and the delivery enhancing compound source of the aerosol-generating article so that a first one of the nicotine source and the delivery enhancing compound source has a higher temperature than a second one of the nicotine source and the delivery enhancing compound source.

Differential heating of the nicotine source and the delivery enhancing compound source of the aerosol-generating article by the aerosol-generating device of aerosol-generating systems according to the invention allows precise control of the amount of nicotine and volatile delivery enhancing compound released from the nicotine source and the volatile delivery enhancing compound source, respectively. This advantageously enables the vapour concentrations of the nicotine and the volatile delivery enhancing compound to be controlled and balanced proportionally to yield an efficient reaction stoichiometry. This advantageously improves the efficiency of the formation of an aerosol and the consistency of the nicotine delivery to a user. It also advantageously reduces the delivery of unreacted nicotine and unreacted volatile delivery enhancing compound to a user.

In certain embodiments, the aerosol-generating device may be configured to heat one or both of the nicotine source and the volatile delivery enhancing compound source of the aerosol-generating article so that the nicotine source has a higher temperature than the delivery enhancing compound source.

In certain embodiments, the aerosol-generating device may be configured to heat both the nicotine source and the volatile delivery enhancing compound source of the aerosol-generating article so that the nicotine source has a higher temperature than the delivery enhancing compound source.

In other embodiments, the aerosol-generating device may be configured to only heat the nicotine source of the aerosol-generating article so that the nicotine source has a higher temperature than the delivery enhancing compound source.

Preferably, the aerosol-generating device is configured to heat the nicotine source of the aerosol-generating article to a temperature of between about 50 degrees Celsius and about 150 degrees Celsius. In certain embodiments, the aerosol-generating device is configured to heat the nicotine source of the aerosol-generating article to a temperature of between about 50 degrees Celsius and about 100 degrees Celsius.

Preferably, the aerosol-generating device is configured to heat the volatile delivery enhancing compound source of the aerosol-generating article to a temperature of between about 30 degrees Celsius and about 100 degrees Celsius. In certain embodiments, the aerosol-generating device is configured to heat the volatile delivery enhancing compound source of the aerosol-generating article to a temperature of between about 30 degrees Celsius and 70 degrees Celsius.

The aerosol-generating device may further comprise a controller configured to control a supply of power to the heating means.

The aerosol-generating device may further comprise a power supply for supplying power to the heating means and a controller configured to control a supply of power from the power supply to the heating means. Alternatively, the controller of the aerosol-generating device may be configured to control a supply of power from an external power supply to the heating means.

The heating means may comprise an electric heater powered by an electric power supply. Where the heating means is an electric heater, the aerosol-generating device may further comprise an electric power supply and a controller comprising electronic circuitry configured to control the supply of electric power from the electric power supply to the electric heater.

The power supply may be a DC voltage source. In preferred embodiments, the power supply is a battery. For example, the power supply may be a Nickel-metal hydride battery, a Nickel cadmium battery, or a Lithium based battery, for example a Lithium-Cobalt, a Lithium-Iron-Phosphate or a Lithium-Polymer battery. The power supply may alternatively be another form of charge storage device such as a capacitor. The power supply may require recharging and may have a capacity that allows for the storage of enough energy for use of the aerosol-generating device with one or more aerosol-generating articles.

Alternatively or in addition, the heating means may comprise a non-electric heater, such as a chemical heating means.

The heating means of the aerosol-generating device may comprise one or more heating elements.

The one or more heating elements may extend fully or partially along the length of the cavity.

The heating means of the aerosol-generating device may comprise one or more internal heating elements.

Alternatively or in addition, the heating means of the aerosol-generating device may comprise one or more external heating elements. The one or more external heating elements may comprise one or more external heating elements extend fully or partially around the circumference of the cavity.

In such embodiments, the heating means may be configured so that the one or more external heating elements are in direct thermal contact with the aerosol-generating article. Alternatively, the heating means may be configured may be configured so that the one or more external heating elements are positioned close to the aerosol-generating article without contacting it. In other embodiments, the heating means may be configured may be configured so that the one or more external heating elements are in indirect thermal contact with the aerosol-generating article.

Preferably, the one or more heating elements are heated electrically. However, other heating schemes may be used to heat the one or more heating elements. For example, the one or more external heating elements may be heated by conduction from another heat source. Alternatively, each heating element may comprise an infra-red heating element, a photonic source, or an inductive heating element.

Each heating element may comprise a heat sink, or heat reservoir comprising a material capable of absorbing and storing heat and subsequently releasing the heat over time. The heat sink may be formed of any suitable material, such as a suitable metal or ceramic material. Preferably, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, a metal salt, a mixture of eutectic salts or an alloy.

The heat sink or heat reservoir may be arranged such that it is directly in contact with the aerosol-generating article and can transfer the stored heat directly to one or both of the nicotine source and the volatile delivery enhancing compound source of the aerosol-generating article. Alternatively, the heat stored in the heat sink or heat reservoir may be transferred to one or both of the nicotine source and the volatile delivery enhancing compound source of the aerosol-generating article by means of a thermal conductor, such as a metallic tube.

In a preferred embodiment each heating element comprises an electrically resistive material. Each heating element may comprise a non-elastic material, for example a ceramic sintered material, such as alumina ($Al_2O_3$) and silicon nitride ($Si_3N_4$), or printed circuit board or silicon rubber. Alternatively, each heating element may comprise an elastic, metallic material, for example an iron alloy or a nickel-chromium alloy. The one or more heating elements may be flexible heating foils on a dielectric substrate, such as polyimide. Where the heating means comprises one or more external heating elements, the flexible heating foils can be shaped to conform to the perimeter of the cavity of the aerosol-generating device. Alternatively, the one or more heating elements may be metallic grid or grids, flexible printed circuit boards, or flexible carbon fibre heaters.

Other suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium- and manganese-alloys, and super-alloys based on nickel, iron, cobalt, stainless steel, Timetal® and iron-manganese-aluminium based alloys. Timetal® is a registered trade mark of Titanium Metals Corporation, 1999 Broadway Suite 4300, Denver, Colo. In composite materials, the electrically resistive material may optionally be embedded in, encapsulated or coated with an insulating material or vice-versa, depending on the kinetics of energy transfer and the external physicochemical properties required.

The aerosol-generating device may comprise: a first temperature sensor configured to sense the temperature of the nicotine source of the aerosol-generating article; and a second temperature sensor configured to sense the temperature of the second compartment of the volatile delivery enhancing compound source.

In such embodiments, the controller may be configured to control a supply of power to the one or more heating elements based on the temperature of the nicotine source of the aerosol-generating article sensed by the first temperature sensor and the temperature of the volatile delivery enhancing compound source of the aerosol-generating article sensed by the second temperature sensor.

The heating means may comprise one or more heating elements formed using a metal having a defined relationship between temperature and resistivity. In such embodiments, the metal may be formed as a track between two layers of suitable insulating materials. Heating elements formed in this manner may be used to both heat and monitor the temperature of the nicotine source and the volatile delivery enhancing compound source of the aerosol-generating article.

In certain embodiments the aerosol-generating device may comprise: a first heating element configured to heat the nicotine source of the aerosol-generating article; and a second heating element configured to heat the volatile delivery enhancing compound source of the aerosol-generating article; and a controller configured to control a supply of power to the first heating element and the second heating element so that the first heating element has a higher temperature than the second heating element.

In other embodiments, the aerosol-generating device may comprise: one or more external heating elements; a first heat transfer element positioned between the one or more heating elements and the cavity; and a second heat transfer element positioned between the one or more heating elements and the cavity, wherein the first heat transfer element has a lower thermal conductivity than the second heat transfer element.

In further embodiments in which the aerosol-generating article comprises a first compartment comprising the nicotine source and a second compartment comprising the volatile delivery enhancing compound source, the first compartment of the aerosol-generating article may have a lower thermal conductivity than the second compartment of the aerosol-generating article.

The first compartment and the second compartment may be formed from different materials. The first compartment may be formed from a first material and the second compartment may be formed from a second material, wherein the bulk thermal conductivity of the second material is less than the bulk thermal conductivity of the first material.

The first compartment may be formed from a conductive material. For example, the first compartment may be formed from a material having a bulk thermal conductivity of greater than about 15 W per meter Kelvin (W/(m·K)) at 23° C. and a relative humidity of 50% as measured using the modified transient plane source (MTPS) method.

The second compartment may be formed from an insulating material. For example, the second compartment may be formed from a material having a bulk thermal conductivity of less than about 5 W per meter Kelvin (W/(m·K)) at 23° C. and a relative humidity of 50% as measured using the modified transient plane source (MTPS) method.

Alternatively or in addition, the first compartment and the second compartment may be of different construction. For example, the thickness of a perimeter of the second compartment may be greater than the thickness of a perimeter of the first compartment so that the second compartment has a lower thermal conductivity than the first compartment.

In such embodiments, where the heating means of the aerosol-generating device comprises an external heater, heat transfer from the external heater to the second compartment of the aerosol-generating article is lower than heat transfer from the external heater of the aerosol-generating device to the first compartment of the aerosol-generating article due to the lower thermal conductivity of the second compartment compared to the first compartment. This results in the first compartment of the aerosol-generating article having a higher temperature than the second compartment of the aerosol-generating article.

For the avoidance of doubt, features described above in relation to one embodiment of the invention may also be applicable to other embodiment of the invention. In particular, features described above in relation to aerosol-generating systems according to the invention may also relate, where appropriate to aerosol-generating articles and aerosol-generating devices for use in aerosol-generating systems according to the invention, and vice versa.

Figure 1B:
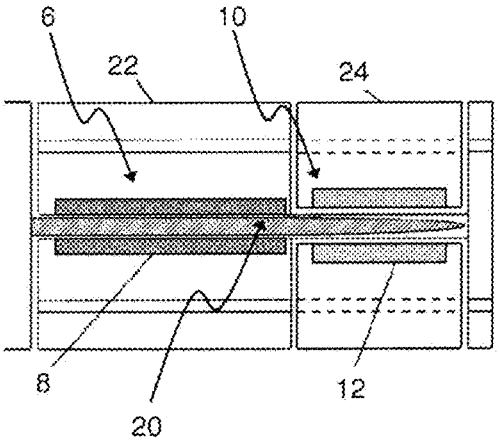
Figure 2A:
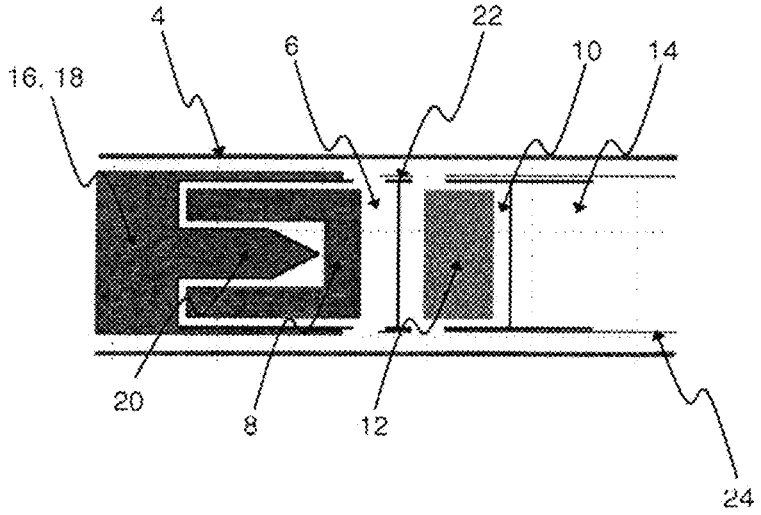
Figure 2B:
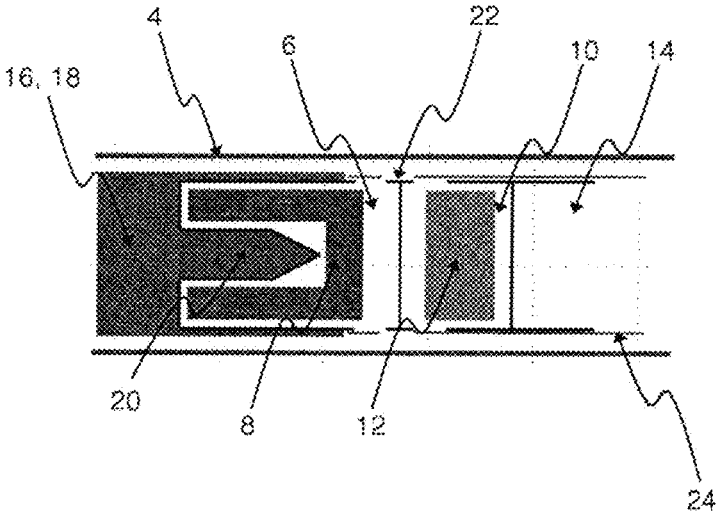
Figure 3A:
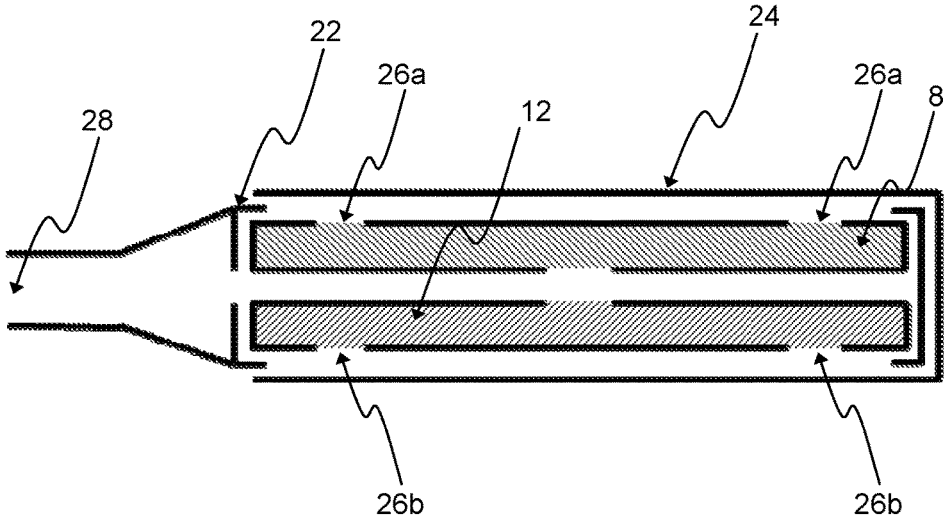
Figure 3B:
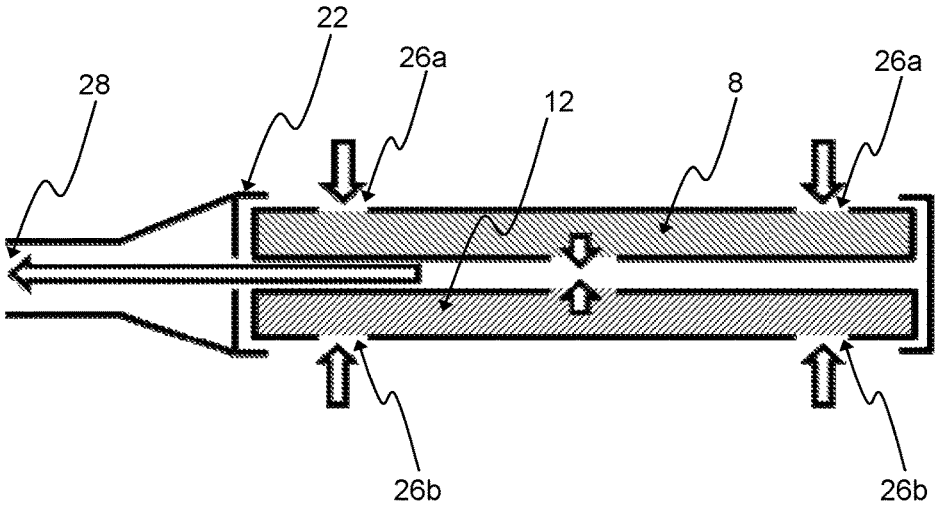
Figure 4A:
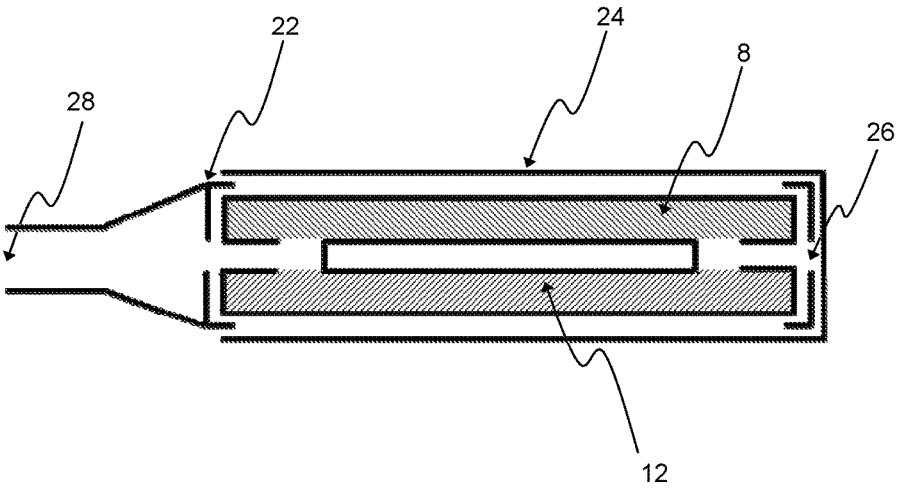
Figure 4B:
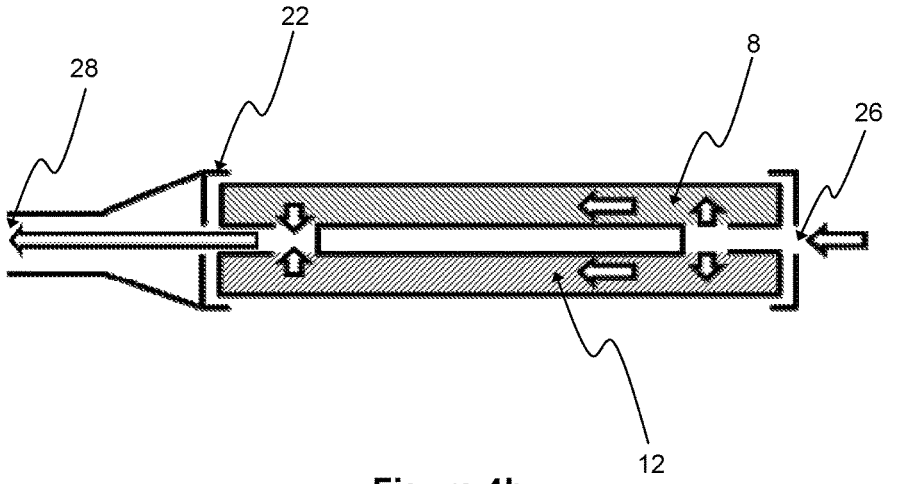

The invention will now be further described with reference to the accompanying drawings in which:

FIGS. 1*a* and 1*b* show schematic longitudinal cross-sections of an aerosol-generating system according to a first embodiment of the invention comprising an aerosol-generating article and an aerosol-generating device;

FIGS. 2*a* and 2*b* show schematic longitudinal cross-sections of an aerosol-generating system according to a second embodiment of the invention comprising an aerosol-generating article and an aerosol-generating device;

FIGS. 3*a* and 3*b* show schematic longitudinal cross-sections of an aerosol-generating system according to a third embodiment of the invention; and FIGS. 4*a* and 4*b* show schematic longitudinal cross-sections of an aerosol-generating system according to a fourth embodiment of the invention.

FIGS. 1*a* and 1*b* schematically show an aerosol-generating system according to a first embodiment of the invention comprising an aerosol-generating article 2 and an aerosol-generating device 4. The aerosol-generating article 2 has an elongate cylindrical housing comprising a first compartment 6 comprising a nicotine source 8, a second compartment 10 comprising a volatile delivery enhancing compound source 12, and a third compartment 14. As shown in FIG. 1, the first compartment 6, the second compartment 10, and the third compartment 14 are arranged in series and in coaxial alignment within the aerosol-generating article 2. The first compartment 6 is located at the distal end of the aerosol-generating article 2. The second compartment 10 is located immediately downstream of and abuts the first compartment 6. The third compartment 14 is located immediately downstream of the second compartment 10 at the proximal end of the aerosol-generating article 2. Instead of or in addition to the third compartment 14, the aerosol-generating article 2 may comprise a mouthpiece at the proximal end thereof.

The aerosol-generating device 4 comprises a housing comprising an elongate cylindrical cavity in which the aerosol-generating article 2 is received, a power source 16, a controller 18 and an internal heater 20. The power source 16 is a battery and the controller 18 comprises electronic circuitry and is connected to the power supply 16 and the internal heater 20.

The length of the cavity is less than the length of the aerosol-generating article 2 so that the proximal end of the aerosol-generating article 2 protrudes from the cavity. The internal heater 20 is positioned centrally within the cavity of the aerosol-generating device 4 and extending along the major axis of the cavity. In use, as the aerosol-generating article 2 is inserted into the cavity of the aerosol-generating device 4 the internal heater 20 is inserted into the first compartment 6 and the second compartment 10 of the aerosol-generating article 2.

As shown in FIG. 1*b*, the first compartment 6 comprising the nicotine source 8 is located in a first of the housing of the aerosol-generating article 2 and the second compartment 10 comprising the volatile delivery enhancing compound source 12 is located in a second portion 24 of the housing of the aerosol-generating article 2.

A plurality of first apertures are provided in the downstream end of the first compartment 6 of the aerosol-generating article 2, a plurality of second apertures are provided in the upstream and downstream ends of the second compartment 10 of the aerosol-generating article 2 and a plurality of third apertures are provided in the upstream end of the third compartment 14 of the aerosol-generating article 2.

The second portion 24 of the housing of the aerosol-generating article 2 is rotatable relative to the first portion 22 of the housing of the aerosol-generating article 2 between an open position and a closed position.

In the open position the plurality of second apertures in the upstream end of the second compartment 10 are aligned with the plurality of first apertures in the downstream end of the first compartment 6 and the plurality of second apertures in the downstream end of the second compartment 10 are aligned with the plurality of third apertures in the upstream end of the third compartment 14.

In the open position an air stream may be drawn into the housing of the aerosol-generating article 2 through an air inlet at the distal end thereof, along an airflow pathway through the housing between the air inlet and an air outlet at the proximal end of the aerosol-generating article 2, and out of the housing of the aerosol-generating article 2 through the air outlet. The airstream drawn along the airflow pathway through the housing between the air inlet and the air outlet passes through the first compartment 6, the second compartment 10 and the third compartment 14 of the aerosol-generating article 2 via the plurality of first apertures in the downstream end of the first compartment 6, the plurality of second apertures in the upstream end of the second compartment 10, the plurality of second apertures in the downstream end of the second compartment 10 and the plurality of third apertures in the upstream end of the third compartment 14.

As the air stream is drawn along the airflow pathway through the housing between the air inlet and the air outlet nicotine vapour is released from the nicotine source in the first compartment 6 into the air stream and volatile delivery enhancing compound vapour is released from the volatile delivery enhancing compound source in the second compartment 10 into the air stream. The nicotine vapour reacts with the volatile delivery enhancing compound vapour in the gas phase in the second compartment 10 and the third compartment 14 to form an aerosol, which is delivered to the user through the air outlet at the proximal end of the aerosol-generating article 2.

In the closed position the plurality of second apertures in the upstream end of the second compartment 10 of the aerosol-generating article 2 are misaligned with the plurality of first apertures in the downstream end of the first compartment 6 of the aerosol-generating article 2. In the closed position the plurality of second apertures in the downstream end of the second compartment 10 of the aerosol-generating article 2 may also be misaligned with the plurality of third apertures in the upstream end of the third compartment 14 of the aerosol-generating article 2.

The misalignment of the plurality of first apertures in the downstream end of the first compartment 6 and the plurality of second apertures in the upstream end of the second compartment 10 in the closed position obstructs the airflow pathway through the housing of the aerosol-generating article 2 between the air inlet and the air outlet. This prevents an air stream from being drawn into the housing of the aerosol-generating article 2 through the air inlet, along the airflow pathway through the housing of the aerosol-generating article 2 between the air inlet and the air outlet, and out of the housing of the aerosol-generating article 2 through the air outlet in the closed position.

FIGS. 2*a* and 2*b* schematically show an aerosol-generating system according to a second embodiment of the invention comprising an aerosol-generating article 2 and an aerosol-generating device 4.

The aerosol-generating device 4 of the aerosol-generating system according to the second embodiment of the invention shown in FIGS. 2*a* and 2*b* is of similar construction and operation as the aerosol-generating device 4 of the aerosol-generating system according to the first embodiment of the invention shown in FIGS. 1*a* and 1*b*. However, in the aerosol-generating device of the aerosol-generating system according to the second embodiment of the invention the internal heater 20 is of reduced length so that as the aerosol-generating article 2 is inserted into the cavity of the aerosol-generating device 4 the internal heater 20 is only inserted into the first compartment 6 of the aerosol-generating article 2.

The aerosol-generating article 2 of the aerosol-generating system according to the second embodiment of the invention shown in FIGS. 2*a* and 2*b* is of similar general construction to the aerosol-generating article 2 of the aerosol-generating system according to the first embodiment of the invention shown in FIGS. 1*a* and 1*b* and comprises a first compartment 6 comprising a nicotine source 8, a second compartment 10 comprising a volatile delivery enhancing compound source 12, and a third compartment 14, which are arranged in series and in coaxial alignment within a housing of the aerosol-generating article 2. However, in the aerosol-generating article of the aerosol-generating system according to the second embodiment of the invention the first compartment 6 comprising the nicotine source 8, the second compartment 10 comprising the volatile delivery enhancing compound source 12, and the third compartment 14 are all located in an elongate cylindrical first portion 22 of the housing of the aerosol-generating article 2. The first portion 22 of the housing of the aerosol-generating article 2 is partially surrounded by an elongate cylindrical second portion 24 of the housing of the aerosol-generating article 2.

As shown in FIGS. 2*a* and 2*b*, a plurality of first apertures are provided in the surface of the first portion 22 of the housing overlying the first compartment 6 and the second compartment 10 and a plurality of second apertures are provided in the surface of the second portion 24 of the housing.

The first portion 22 of the housing and the second portion 24 of the housing are slidable relative to one another along the longitudinal axis of the aerosol-generating article 2 between an open position (shown in FIG. 2*a*) and a closed position (shown in FIG. 2*b*).

In the open position shown in FIG. 2*a*, the second portion 24 of the housing does not surround the plurality of first apertures provided in the surface of the first portion 22 of the housing overlying the first compartment 6 and the plurality of second apertures in the second portion 24 of the housing are aligned with the plurality of first apertures in the first portion 22 of the housing overlying the second compartment 10.

In the open position an air stream may be drawn into the aerosol-generating system through an air inlet at the distal end thereof, along an airflow pathway through the aerosol-generating system between the air inlet and an air outlet at the proximal end of the aerosol-aerosol-generating system, and out of the aerosol-generating system through the air outlet. The airstream drawn along the airflow pathway through the aerosol-generating system between the air inlet and the air outlet passes the first compartment 6, the second compartment 10 and the third compartment 14 of the aerosol-generating article 2.

As the air stream is drawn along the airflow pathway through the aerosol-generating system between the air inlet and the air outlet nicotine vapour is released from the nicotine source in the first compartment 6 into the air stream via the plurality of first apertures in the surface of the first portion 22 of the housing overlying the first compartment 6. As the air stream is drawn along the airflow pathway through the aerosol-generating system between the air inlet and the air outlet volatile delivery enhancing compound vapour is also released from the volatile delivery enhancing compound source in the second compartment 10 into the air stream via the plurality of first apertures in the surface of the first portion 22 of the housing overlying the second compartment 10 and the plurality of second apertures in the surface of the second portion 24 of the housing. The nicotine vapour reacts with the volatile delivery enhancing compound vapour in the gas phase to form an aerosol, which is delivered to the user through the air outlet at the proximal end of the aerosol-generating system.

In the closed position shown in FIG. 2*b*, the second portion 24 of the housing surrounds the plurality of first apertures provided in the surface of the first portion 22 of the housing overlying the first compartment 6 and the plurality of second apertures in the second portion 24 of the housing are misaligned with the plurality of first apertures in the first portion 22 of the housing overlying the second compartment 10.

In the closed position the obstruction of the plurality of first apertures provided in the surface of the first portion 22 of the housing overlying the first compartment 6 by the second portion 24 of the housing and the misalignment of the plurality of first apertures in the first portion 22 of the housing overlying the second compartment 10 and the plurality of second apertures in the surface of the second portion 24 of the housing prevents the release of nicotine vapour from the nicotine source in the first compartment 6 and the release of volatile delivery enhancing compound vapour from the volatile delivery enhancing compound source in the second compartment 10 into an air stream drawn along the airflow pathway through the aerosol-generating system between the air inlet and an air outlet.

FIGS. 3*a* and 3*b* schematically show an aerosol-generating system according to a third embodiment of the invention comprising a housing having a first portion 22 and a second portion 24.

The first portion 22 of the housing comprises a first air inlet 26*a*, a second air inlet 26*b* and an air outlet 28. As shown in FIGS. 3*a* and 3*b*, a nicotine source 8 and a volatile delivery enhancing compound source 12 are arranged in parallel within the first portion 22 of the housing with the nicotine source 8 downstream of the first air inlet 26*a* and upstream of the air outlet 28 and the volatile delivery enhancing compound source 12 downstream of the second air inlet 26*b* and upstream of the air outlet 28.

The second portion 24 of the housing is a removable cap that is configured to fit over the distal end of the first portion 22 of the housing.

The first portion 22 of the housing and the second portion 24 of the housing are movable relative to one another between an open position (shown in FIG. 3*b*) and a closed position (shown in FIG. 3*a*).

In the open position the second portion 24 of the housing is separated from the first portion 22 of the housing.

As illustrated by the arrows in FIG. 3*b*, in the open position a first air stream drawn into the first portion 22 of the housing through the first air inlet 26*a* and along an airflow pathway through the first portion 22 of the housing between the first air inlet 26*a* and the air outlet 28 passes the nicotine source 8 and a second air stream drawn into the first portion 22 of the housing through the second air inlet 26*b* and along an airflow pathway through the first portion 22 of the housing between the second air inlet 26*b* and the air outlet 28 passes the volatile delivery enhancing compound source 12. The nicotine vapour in the first air stream reacts with the volatile delivery enhancing compound vapour in the second air stream in the gas phase to form an aerosol, which is delivered to a user through the air outlet 28.

In the closed position the second portion 24 of the housing is placed over the distal end of the first portion 22 of the housing.

As shown in FIG. 3*a*, in the closed position the first air inlet 26*a* and the second air inlet 26*b* of the first portion 22 of the housing are obstructed by the second portion 24 of the housing. This prevents an air stream from being drawn into first portion 22 of the housing of the aerosol-generating article 2 through the first air inlet 26*a* and the second air inlet 26*b*.

FIGS. 4*a* and 4*b* schematically show an aerosol-generating system according to a fourth embodiment of the invention.

The aerosol-generating system according to the fourth embodiment of the invention shown in FIGS. 4*a* and 4*b* is of similar construction and operation as the aerosol-generating system according to the third embodiment of the invention shown in FIGS. 3*a* and 3*b*. However, in the aerosol-generating system according to the fourth embodiment of the invention the first portion 22 of the housing comprises a single air inlet 26 and an air outlet 28 and the nicotine source 8 and the volatile delivery enhancing compound source 12 are arranged in parallel within the first portion 22 of the housing with the nicotine source 8 and the volatile delivery enhancing compound source 12 both downstream of the air inlet 26 and upstream of the air outlet 28.

As illustrated by the arrows in FIG. 4*b*, in the open position a first portion of an air stream drawn into the first portion 22 of the housing through the air inlet 26 and along an airflow pathway through the first portion 22 of the housing between the air inlet 26 and the air outlet 28 passes the nicotine source 8 and a second portion of the air stream drawn into the first portion 22 of the housing through the air inlet 26 and along an airflow pathway through the first portion 22 of the housing between the air inlet 26 and the air outlet 28 passes the volatile delivery enhancing compound source 12. The nicotine vapour in the first portion of the air stream reacts with the volatile delivery enhancing compound vapour in the second portion of the air stream in the gas phase to form an aerosol, which is delivered to a user through the air outlet 28.

The invention claimed is:

1. An aerosol-generating system, comprising:

a housing having a first portion and a second portion, the housing comprising:

an air inlet;

a nicotine source;

a volatile delivery enhancing compound source; and an air outlet, wherein the first portion of the housing and the second portion of the housing are movable relative to one another from:

an open position in which the nicotine source and the volatile delivery enhancing compound source are both in fluid communication with an airflow pathway through the housing between the air inlet and the air outlet, to a closed position in which (i) the air flow pathway through the housing between the air inlet and the air outlet is blocked such that airflow into the housing through the air inlet, along the airflow pathway through the housing between the air inlet and the air outlet, and out of the housing through the air outlet, is substantially prevented, (ii) the nicotine source and the volatile delivery enhancing compound source are both not in fluid communication with the airflow pathway through the housing between the air inlet and the air outlet, or (iii) the air flow pathway through the housing between the air inlet and the air outlet is blocked such that airflow into the housing through the air inlet, along the airflow pathway through the housing between the air inlet and the air outlet, and out of the housing through the air outlet, is substantially prevented, and the nicotine source and the volatile delivery enhancing compound source are both not in fluid communication with the airflow pathway through the housing between the air inlet and the air outlet, and wherein the first portion of the housing and the second portion of the housing are movable relative to one another from the closed position to the open position.

2. The aerosol-generating system according to claim 1, wherein thy: nicotine source and the volatile delivery enhancing compound source are arranged in series within the housing so that in the open position an air stream drawn along the airflow pathway through the housing between the air inlet and the air outlet passes a first one of the nicotine source and the volatile delivery enhancing compound source and then passes a second one of the nicotine source and the volatile delivery enhancing compound source.

3. The aerosol-generating system according to claim 1, wherein thy: nicotine source and the volatile delivery enhancing compound source are not in fluid communication with one another in the closed position.

4. The aerosol-generating system according to claim 1, wherein the first portion of the housing and the second portion of the housing are slidable relative to one another from the closed position to the open position and from the open position to the closed position.

5. The aerosol-generating system according to claim 1, wherein the first portion of the housing and the second portion of the housing are rotatable relative to one another from the closed position to the open position and from the open position to the closed position.

6. The aerosol-generating system according to claim 1, further comprising:

one or more first apertures in the first portion of the housing; and one or more second apertures in the second portion of the housing, wherein, in the open position, the one or more first apertures in the first portion of the housing and the one or more second apertures in the second portion of the housing are substantially aligned and, in the closed position, the one or more first apertures in the first portion of the housing and the one or more second apertures in the second portion of the housing are substantially misaligned.

7. The aerosol-generating system according to claim 1, wherein the nicotine source and the volatile delivery enhancing compound source are both disposed in the first portion of the housing.

8. The aerosol-generating system according to claim 7, wherein the first portion of the housing comprises the air inlet and the air outlet, and wherein the first portion of the housing and the second portion of the housing are movable relative to one another between:

the open position in which the nicotine source and the volatile delivery enhancing compound source are both in fluid communication with the airflow pathway, which is through the first portion of the housing between the air inlet and the air outlet, and the closed position, in which one or both of the air inlet and the air outlet are blocked by the second portion of the housing.

9. The aerosol-generating system according to claim 7, wherein the second portion of the housing is separated from the first portion of the housing in the open position.

10. The aerosol-generating system according to claim 1, wherein a first one of the nicotine source and the volatile delivery enhancing compound source is located in the first portion of the housing, and a second one of the nicotine source and the volatile delivery enhancing compound source is located in the second portion of the housing.

11. The aerosol-generating system according to claim 1, wherein the housing comprises a first compartment comprising the nicotine source and a second compartment comprising the volatile delivery enhancing compound source.

12. The aerosol-generating system according to claim 11, wherein one or both of the first compartment and the second compartment are initially sealed by one or more frangible seals.

13. The aerosol-generating system according to claim 1, wherein thy: volatile delivery enhancing compound source comprises an acid.

14. The aerosol-generating system according to claim 13, wherein the acid is selected from the group consisting of lactic acid, 3-methyl-2-oxovaleric acid, pyruvic acid, 2-oxovaleric acid, 4-methyl-2-oxovaleric acid, 3-methyl-2-oxobutanoic acid, 2-oxooctanoic acid, and combinations thereof.

15. The aerosol-generating system according to claim 1, further comprising:

an aerosol-generating article comprising the nicotine source and the volatile delivery enhancing compound source; and an aerosol-generating device comprising:

a cavity configured to receive the nicotine source and the volatile delivery enhancing compound source of the aerosol-generating article; and a heater configured to heat one or both of the nicotine source and the volatile delivery enhancing compound source of the aerosol-generating article within the cavity.

* * * * *